US009512587B2

(12) United States Patent
Arima et al.

(10) Patent No.: US 9,512,587 B2
(45) Date of Patent: Dec. 6, 2016

(54) GROUND IMPROVEMENT METHOD

(71) Applicants: Heisei Techno's Co., Ltd., Higashi-Osaka-shi Osaka (JP); Mainmark Ground Engineering Pty Ltd, Sydney, NSW (AU)

(72) Inventors: Sigeharu Arima, Higashi-Osaka (JP); Yasunori Horiuchi, Higashi-Osaka (JP)

(73) Assignees: HEISEI TECHNO'S CO., LTD., Higashi-Osaka-Shi (JP); MAINMARK GROUND ENGINEERING PTY LTD, Sydney (AU)

( * ) Notice: Subject to any disclaimer, the term of this patent is extended or adjusted under 35 U.S.C. 154(b) by 0 days.

(21) Appl. No.: 15/104,473

(22) PCT Filed: Dec. 16, 2013

(86) PCT No.: PCT/JP2013/083649
§ 371 (c)(1),
(2) Date: Jun. 14, 2016

(87) PCT Pub. No.: WO2015/092854
PCT Pub. Date: Jun. 25, 2015

(65) Prior Publication Data

US 2016/0312429 A1 Oct. 27, 2016

(51) Int. Cl.
*E02D 3/12* (2006.01)

(52) U.S. Cl.
CPC ..... *E02D 3/12* (2013.01); *E02D 2250/003* (2013.01)

(58) Field of Classification Search
CPC ..... E02D 3/12; E02D 3/123
See application file for complete search history.

(56) References Cited

U.S. PATENT DOCUMENTS 2,627,169 A * 2/1953 Poulter ..... E02D 3/12 405/267
3,667,236 A * 6/1972 Rosene ..... E02D 3/12 166/295
3,690,106 A * 9/1972 Tregembo ..... E02D 3/12 166/299

(Continued)

FOREIGN PATENT DOCUMENTS

JP 6-306846 A 11/1994
JP 10-18282 A 1/1998

(Continued)

*Primary Examiner* — Benjamin Fiorello
(74) *Attorney, Agent, or Firm* — Birch, Stewart, Kolasch & Birch, LLP

(57) ABSTRACT

There is provided a method that achieves ground reinforcement, a rise of ground surface level, and ground surface flattening, and so forth even on ground free of a building construction on it or soft ground. The method involves: determination of the degree of consolidation at a grout injection depth position; prediction of a permeation radius at which grout will permeate first on the basis of the degree of consolidation and the amount of grout for single-shot injection; setting of a plurality of grout injection points so as to be spaced apart by an adjacent distance greater than twice the permeation radius; starting of time-spaced injections at each grout injection point; and formation of a solidified portion during the first injection and formation of an enlarged solidified portion during the second injection.

12 Claims, 12 Drawing Sheets

(56) References Cited

U.S. PATENT DOCUMENTS

| | | | | |
|---|---|---|---|---|
| 6,821,056 | B1 * | 11/2004 | Mansour | E02D 27/48 405/230 |
| 8,690,486 | B2 * | 4/2014 | Barron | E02D 3/12 405/263 |
| 2002/0098042 | A1 | 7/2002 | Canteri | |
| 2008/0205995 | A1 * | 8/2008 | Canteri | E21F 15/005 405/263 |
| 2011/0103899 | A1 * | 5/2011 | Wang | E02D 3/12 405/270 |
| 2014/0126960 | A1 * | 5/2014 | Green | E02D 3/02 405/36 |

FOREIGN PATENT DOCUMENTS

| | | | |
|---|---|---|---|
| JP | 3126896 | B2 | 1/2001 |
| JP | 2001-510514 | A | 7/2001 |
| JP | 2003-232030 | A | 8/2003 |
| JP | 3653305 | B2 | 5/2005 |
| JP | 2010-236181 | A | 10/2010 |
| JP | 4672693 | B2 | 4/2011 |
| JP | 2011-208360 | A | 10/2011 |

* cited by examiner

GROUND IMPROVEMENT METHOD

TECHNICAL FIELD

The present invention relates to a ground improvement method that achieves ground reinforcement, a rise of ground surface level, and ground surface flattening, and so forth even on ground free of a building construction on it or soft ground.

BACKGROUND ART

As a well-known ground improvement method, heretofore it has been customary to inject self-hardening grout into ground to increase the degree of consolidation in the ground for ground reinforcement. As the grout, in addition to instantaneously-hardened grout characterized by short gelation time, slowly-hardened grout characterized by long gelation time is used.

As a ground improvement method aimed at restoring a building construction which has undergone uneven settlement due to earthquake or excavating work in a nearby area, there is proposed a technology to inject grout into that part of ground where building settlement has occurred to form a solidified support layer in the ground, so that the building construction, including its foundation, as a whole can be lifted up under a reaction force resulting from the layer formation (refer to Patent Literature 1, for example).

On the other hand, as a ground improvement method aimed at achieving ground reinforcement or water shutoff for, for example, soft ground, there is proposed a technology to control the rate of grout injection, grout injection pressure, selection between start and stop of grout injection, etc. for each of a large number of grout injection points on an individual basis to cope with the difference in soil conditions (coefficient of water permeability, porosity, etc.) between geological layers (refer to Patent Literatures 2 and 3, for example).

By way of another example of ground improvement methods, there is known a technology to form a columnar solidified support portion in ground by directing a jet of grout into a vertical hole formed in the ground by excavation (refer to Patent Literature 4, for example).

PRIOR ART REFERENCE

Citation List

Patent Literature 1: Japanese Patent No. 3126896

Patent Literature 2: Japanese Unexamined Patent Publication JP-A 2003-232030

Patent Literature 3: Japanese Patent No. 4672693

Patent Literature 4: Japanese Unexamined Patent Publication JP-A 6-306846 (1994)

SUMMARY OF INVENTION

Technical Problem

The ground improvement method disclosed in Patent Literature 1 is advantageous for use with ground beneath a building construction. However, in ground free of a building construction on it, since the reaction force resulting from the formation of the solidified support layer in the ground cannot be suppressed from above the ground, it follows that the ground surface takes on localized prominences, which are swollen spots corresponding to grout injection points.

Therefore, a heavy item which substitutes as a building construction needs to be prepared, and grading of the ground surface needs to be done in the event of development of prominences as well, at much expense in time and effort. After all, it has been considered that this method does not lend itself to building-free ground improvement.

Meanwhile, in the ground improvement method disclosed in, for example, Patent Literatures 2 and 3, the rate of grout injection, grout injection pressure, selection between start and stop of grout injection, etc. are determined under the control of a large number of installed grout injection pumps. In this case, the monitoring of ground conditions may entail an increase in complexity in control operation or a lack of stability in control operation, thus causing a decrease in control accuracy (inconsistency between the amount of grout supply and ground conditions). Another problem is a great increase in the costs of equipment instruments, and more specifically, many devices such as detectors are required for the control of grout injection conditions, and also sophisticated control units and injection pumps need to be prepared.

In the ground improvement method disclosed in Patent Literature 4, a vertical hole needs to be formed in ground by excavation, wherefore execution of extensive construction work using large-sized construction machines is inevitable, thus causing a great increase in construction costs. Furthermore, the delivery of large-sized construction machines for use to a narrow construction site or a construction site situated ahead of a narrow road is difficult, and it is also difficult to form a plurality of columnar solidified support portions in different areas of ground at one time.

The present invention has been devised in view of the circumstances as mentioned supra, and accordingly its object is to provide a ground improvement method that achieves an increase of the degree of consolidation in ground with ease by exploiting a reaction force resulting from the formation of solidified support layers in the ground, and thus enables ground reinforcement, a rise of ground surface level, and ground surface flattening, and so forth even on ground free of a building construction on it or soft ground.

Solution to Problem

In order to accomplish the above object, the following means is adopted for the implementation of the present invention.

That is, a ground improvement method pursuant to the present invention comprises: determining the degree of consolidation at a depth position at which grout injection is to be performed within ground which is a target of ground improvement; predicting a permeation radius at which grout will permeate first about each grout injection point on the basis of the degree of consolidation obtained at the depth position and the amount of grout to be injected per single-shot injection; setting a plurality of grout injection points so as to be spaced apart by an adjacent distance which is greater than twice the permeation radius so predicted; starting time-spaced injections at each grout injection point in accordance with a cycle of operation comprising single-shot grout injection, pausing for a certain period of time required for solidification of injected grout, and at least one additional single-shot grout injection at each grout injection point; and causing grout injected in the first injection to form an independent solidified portion at each grout injection point, and causing grout injected in the next injection to diffuse around in the form of interlocked tree roots, while fracturing the solidified portion formed by the first injection, for formation of an enlarged solidified portion.

In the present invention, it is preferable that a solidified support layer is formed so as to extend along ground surface within the improvement target ground by repeating the time-spaced injections until the ground located between the adjacent grout injection points is consolidated under the interaction between the enlarged solidified portions formed at their respective grout injection points. As employed herein, "the interaction between the enlarged solidified portions" involves a condition where the enlarged solidified portions cross each other.

In the present invention, it is preferable that the time interval between termination of single-shot grout injection at a certain grout injection point and initiation of a succeeding grout injection at the same grout injection point is shorter than the gelation time of the previously injected grout.

It is also preferable that, when the result of geological survey conducted on the improvement target ground in the direction of geological layer thickness has indicated the presence of a stack of a highly consolidated layer having a high degree of consolidation and a lowly consolidated layer having a low degree of consolidation located below the highly consolidated layer within a range corresponding to a depth at which ground improvement is to be effected, then the lowly consolidated layer is defined as a depth position at which grout is injected.

In the present invention, it is preferable that the distribution of ground surface rises is monitored in the course of formation of the solidified support layer, and, when a grout injection point situated in a locally swollen area is observed, then grout injection at this grout injection point is brought to a halt, yet grout injection at a grout injection point situated in a prominence-free area is continued, so that the upper ends of swollen areas can be rendered uniform in level throughout the entire region on the improvement target ground.

It is also preferable that the distribution of ground surface rises is monitored in the course of formation of the solidified support layer, and, when an area having a relatively low surface level is observed, execution of the time-spaced grout injections at a grout injection point situated in this area comes first, so that flattening of the ground surface of the entire region on the improvement target ground can be sustained.

In the present invention, it is preferable that, in effecting grout injection at the grout injection points, a certain number of the grout injection points are bunched together in groups, and, according to the order of arrangement of a plurality of the grout injection points in each group, injections are performed sequentially in respective grout injection points, while repeating supply and stop of the supply in turn at different timings, in a go-around manner as one cycle of operation, and, upon the completion of one cycle, the procedure proceeds to a next cycle.

It is also preferable that a plurality of depth positions at which grout injection is to be effected are set in a depth direction for individual grout injection points, respectively, and, after the formation of a solidified support layer at the deepest one of the thereby set depth positions, a grout injection depth is shifted to a position one step higher than the previous depth position for the formation of the next solidified support layer, so that solidified support layers vertically arranged in multi-stage form can be formed at each grout injection point.

Advantageous Effects of Invention

According to the ground improvement method pursuant to the present invention, the degree of consolidation in ground can be increased with ease under a reaction force resulting from the formation of solidified support layers in the ground, and thus ground reinforcement, a rise of ground surface level, and ground surface flattening, and so forth can be achieved even on ground free of a building construction on it or soft ground.

DESCRIPTION OF EMBODIMENTS

Hereinafter, embodiments of the present invention will be described with reference to drawings.

Figure 5:
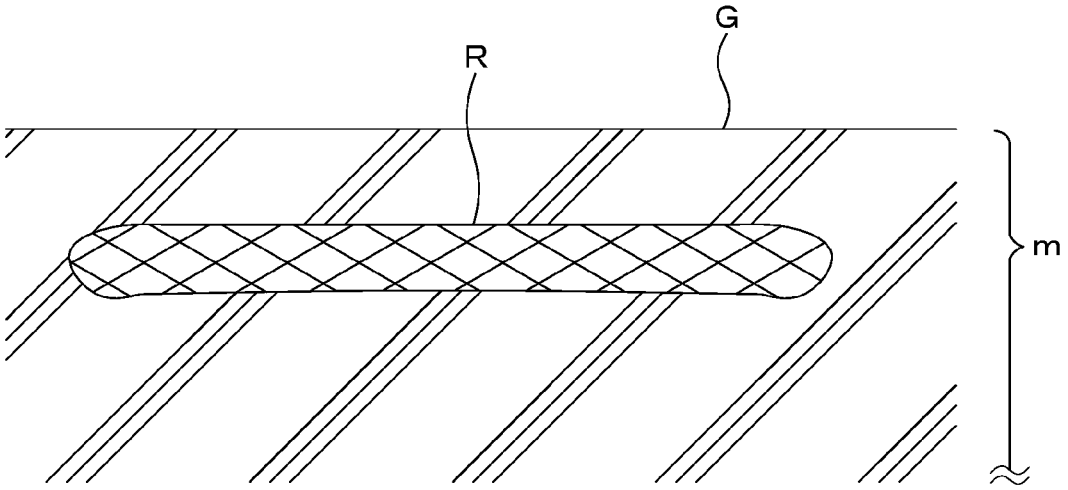
FIG. 5 is a lateral sectional view showing a condition where the ground improvement method pursuant to the present invention is applied to improvement target ground with highly consolidated geological layers.
Figure 6:
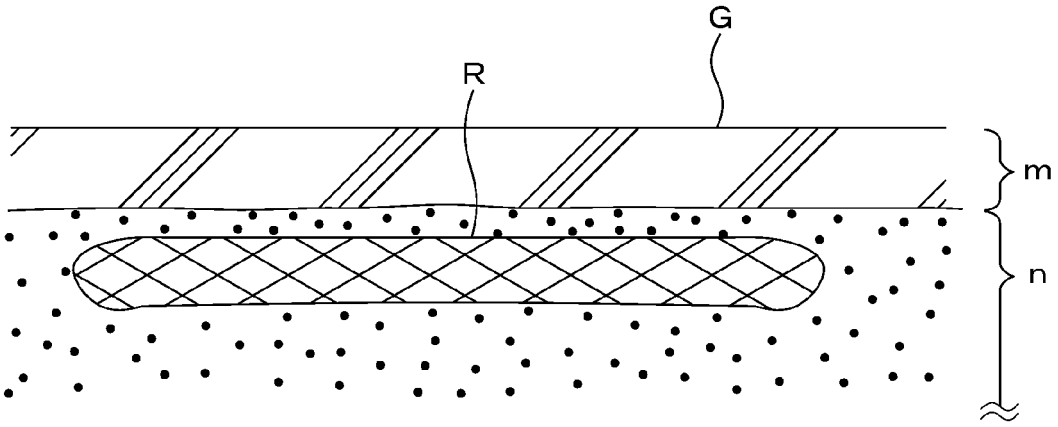
FIG. 6 is a lateral sectional view showing a state where the ground improvement method pursuant to the present invention is applied to improvement target ground with a stack of a lowly consolidated layer and a highly consolidated layer located below the lowly consolidated layer.

As shown in FIGS. 5 and 6 for example, in a ground improvement method pursuant to the present invention, a grout solidified support layer R is formed in ground G by means of grout injection, and, under a reaction force resulting from the formation, the degree of consolidation in the ground G is increased, and also, in certain circumstances, the level of the surficial area of the ground G can be raised, thus imparting desired soil stability to the ground for improvement. According to the ground improvement method pursuant to the present invention, not only it is possible to achieve ground improvement for ground G beneath a building construction, but it is also possible to achieve ground improvement for ground G free of a building construction on it and soft ground G.

While, in the present specification, the term "solidification" refers to a solid state in principle, the terms "solidified portion" and "enlarged solidified portion" may be construed as encompassing, in addition to a solid state, a gel or jelly state, namely a state of transition from a liquid phase to a solid phase, and a state in which a small amount of liquid is contained in a solid.

In the ground improvement method pursuant to the present invention, the first step is to conduct geological survey on the ground G, which is the target of ground improvement, in the direction of geological layer thickness, namely a direction from the ground surface to the underground (for example, Swedish sounding test). In this geological survey, investigation is made on a depth at which a geological layer having a high degree of consolidation, namely a highly consolidated layer in is found, and, in accordance with the highly consolidated layer m depth, a depth position at which grout is to be injected (hereafter referred to as "grout injection layer") is determined.

For example, as shown in FIG. 5, when the highly consolidated layer m exists in the ground surficial area and it has been found that the grout solidified support layer R can be formed within the highly consolidated layer m, then the location of the grout injection layer is set within the highly consolidated layer m. Judgment as to whether the solidified support layer R can be formed is made on the basis of the possibility of leaving, in an area of the ground located above the solidified support layer R to be formed, a part which has a layer thickness large enough to allow the formation of the solidified support layer R without causing cracking or the like trouble in the ground surface layer, and allows effective propagation of a solidified support layer-forming pressure therethrough.

However, when the ground surficial area is of a geological layer having a low degree of consolidation (cohesive soil, sandy soil, conglomerate soil, etc.), the presence or absence of the highly consolidated layer m in a part below this lowly consolidated layer is checked. When the result of the investigation has indicated that the highly consolidated layer m is present, and that an adequate layer thickness can be imparted to the highly consolidated layer m, then the location of the grout injection layer is set within the highly consolidated layer m.

It is noted that, as shown in FIG. 6, even if the highly consolidated layer m is found in the ground surficial area, when the highly consolidated layer m is judged as being below the required level of layer thickness, or, when the ground surficial area is of a lowly consolidated layer, and the highly consolidated layer m lying below the lowly consolidated layer is judged as being below the required level of layer thickness, then investigation is made on the presence or absence of a stack of lowly consolidated layers n in a part below the highly consolidated layer m. When the result of the investigation has indicated that the lowly consolidated layers n exist below the highly consolidated layer m, then the location of the grout injection layer is set within the lowly consolidated layers n for the formation of the solidified support layer R.

The determination of a grout injection layer depth based on geological survey accompanies acquisition of the degree of consolidation in the grout injection layer. However, for example, when a grout injection layer depth can be determined from the start of work without the necessity of conducting laborious geological survey, with the consequence that the degree of consolidation in the grout injection layer remains unknown, then investigation on the degree of consolidation is carried out in advance of the grout injection layer locating step to obtain the degree of consolidation in the grout injection layer in numerical data form.

Meanwhile, to inject a predetermined small amount of the grout at time-spaced intervals in an intermittent manner (this is not continuous injecting operation), which will hereafter be referred to as "single-shot injection", the amount of the grout to be injected per single-shot injection is set. The grout amount for single-shot injection may either be set concurrently with the determination of the grout injection layer depth or be set prior to or after that determination.

Figure 1A:
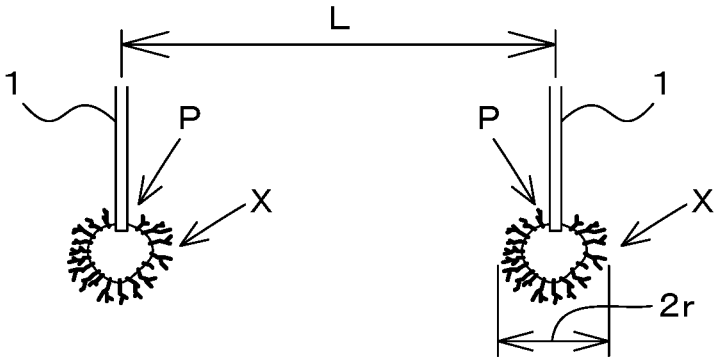
FIG. 1 is a lateral sectional view schematically illustrating how a solidified support layer is to be formed by the ground improvement method pursuant to the present invention on a step-by-step basis.
Figure 2A:
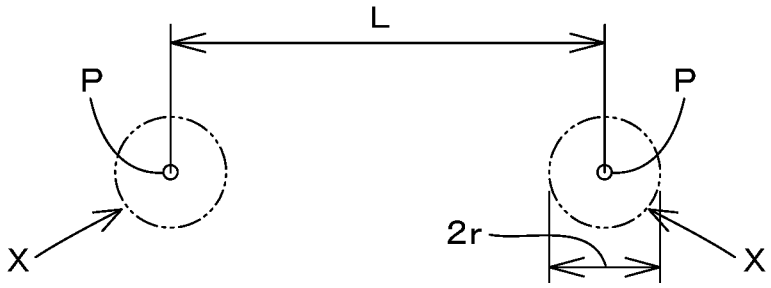
FIG. 2 is a plan view showing conditions of grout permeation corresponding to FIGS. 1(A), 1(B), and 1(C), respectively.

Then, on the basis of the grout amount for single-shot injection and the previously-acquired degree of consolidation in the grout injection layer, the radius of a grout permeable area about a grout injection point (individual grout injection points P), namely a permeation radius r is predicted (in FIGS. 1(A) and 2(A), a permeation diameter is designated as [2r]). The prediction of the permeation radius r is made with consideration given to the viscosity of the grout, the grout injection pressure, the rate of grout injection, the internal temperature of the ground, etc. on an as needed basis. Moreover, when the predicted permeation radius r differs between the adjacent grout injection points P, P, the larger one of the values of permeation radii r is adopted for use.

Figure 3:
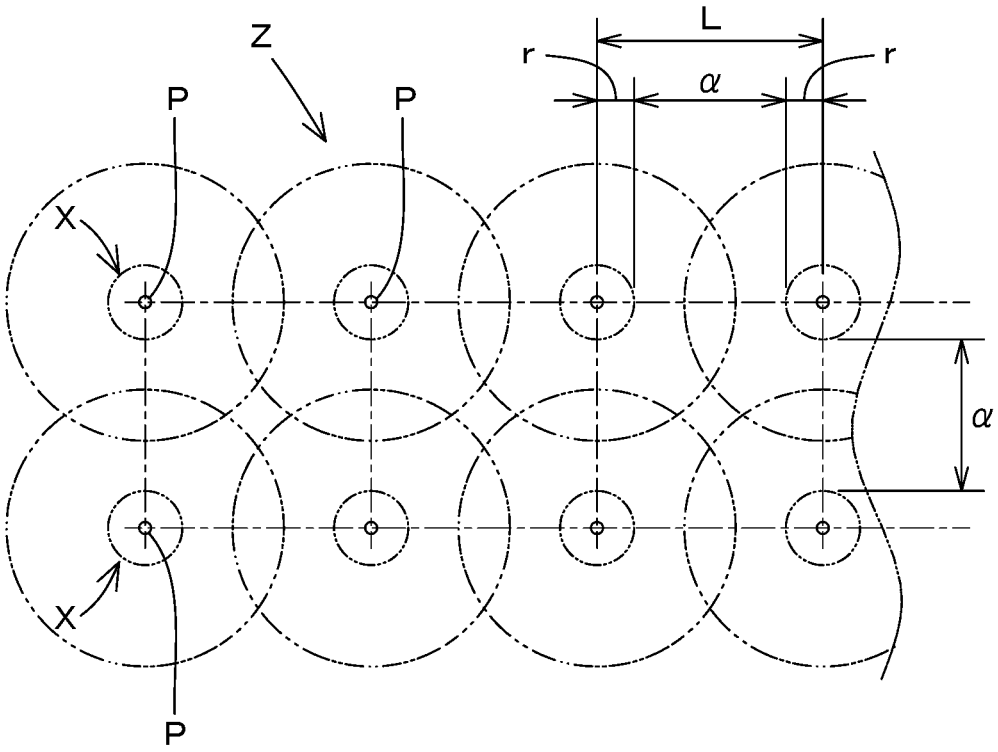
FIG. 3 is a plan view of an example of injection point arrangement, showing a plurality of grout injection points arranged in order.
Figure 4:
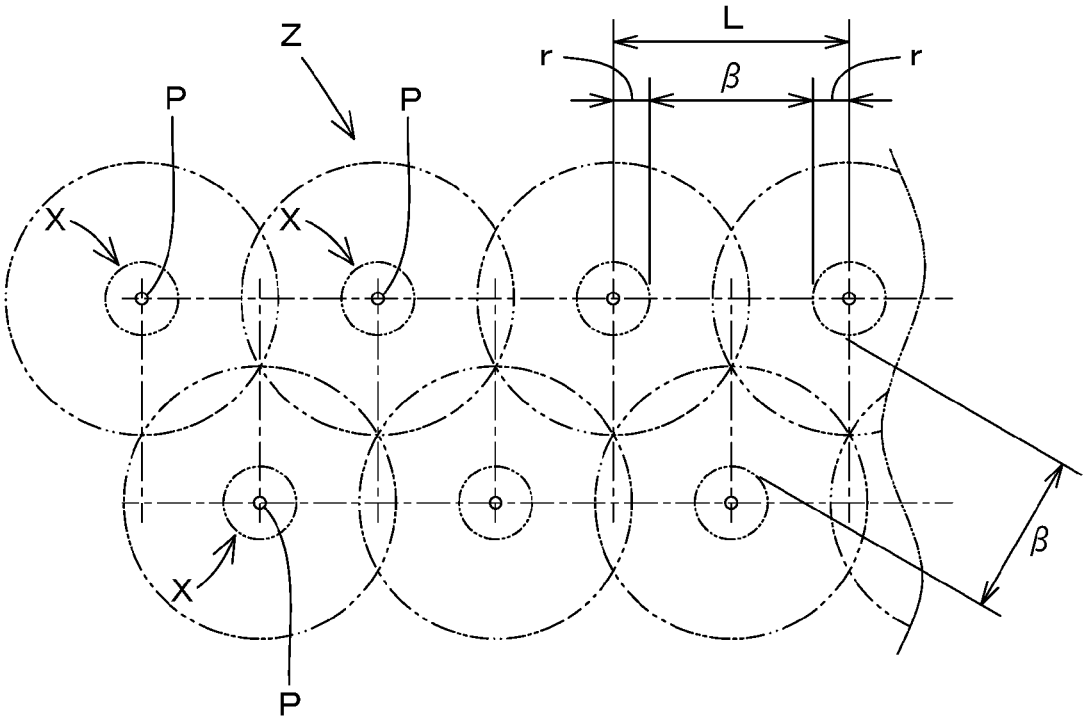
FIG. 4 is a plan view of an example of injection point arrangement, showing a plurality of grout injection points arranged in a staggered configuration at one-half the pitch of the grout injection points.

After the permeation radius r prediction as above described, a plurality of grout injection points P are set so that they are spaced apart by an adjacent distance L greater than twice the permeation radius r (equivalent to [$2r+\alpha$] as shown in FIG. 3 and [$2r+\beta$] as shown in FIG. 4). For example, the adjacent distance L between the adjacent grout injection points P falls in the range of 1 m to 3 mm.

The individual grout injection points P may either be arranged equidistantly both in a vertical direction (corresponding to a direction from top to bottom of FIG. 3) and in a horizontal direction (corresponding to a direction from right to left of FIG. 3) in matrix form as exemplified in FIG. 3, or be spaced in two rows in a staggered configuration at one-half the pitch of a plurality of the grout injection points aligned in a horizontal direction (corresponding to a direction from right to left of FIG. 4) as exemplified in FIG. 4. Although the grout injection points are illustrated as being arranged in two rows in FIGS. 3 and 4, they may be arranged in three or more rows.

Following the completion of setting of the grout injection points P as above described, time-spaced injections are started at each grout injection point P. The time-spaced injections refer to a cycle of operation comprising single-shot grout injection, pausing for a certain period of time required for solidification (in addition to a solid state, a state of transition from a liquid phase to a solid phase is included) of the injected grout in the ground G, and additional single-shot grout injection at the same position.

The time-spaced injecting operation provides the following situation.

That is, as shown in FIGS. 1(A) and 2(A), upon the grout being injected into the ground from each grout injection point P as the first injection, then the grout combines with the soil to form an independent solidified portion X in agglomerate form. The amount of the grout per injection is set to be small and the injection time is short, wherefore the grout remains in a liquid state and will not diffuse into the ground. Thus, the grout stays in small agglomerate form around the grout injection point P, wherefore the solidified portion X can be formed without fail.

The solidified portion X formed by the first injection is susceptible to resistance against downward permeation under the influence of, for example, earth pressure, and thus tends to diffuse horizontally in the course of solidification (within a gelation time period).

Moreover, since the individual grout injection points P are spaced apart by the adjacent distance L (the distance greater than twice the grout permeation radius r), it follows that the adjacent solidified portions X formed by the first injection are maintained in spaced relation to each other (spacing is secured between the adjacent solidified portions X), and will not cross each other or combine with each other. Thus, the individual solidified portions X become structurally independent bodies without fail.

Figure 1B:
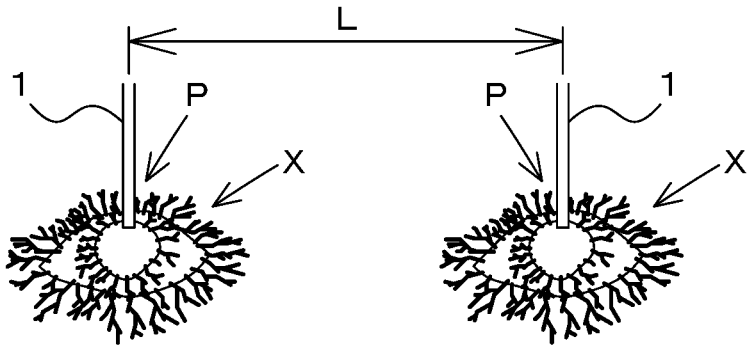
Figure 2B:
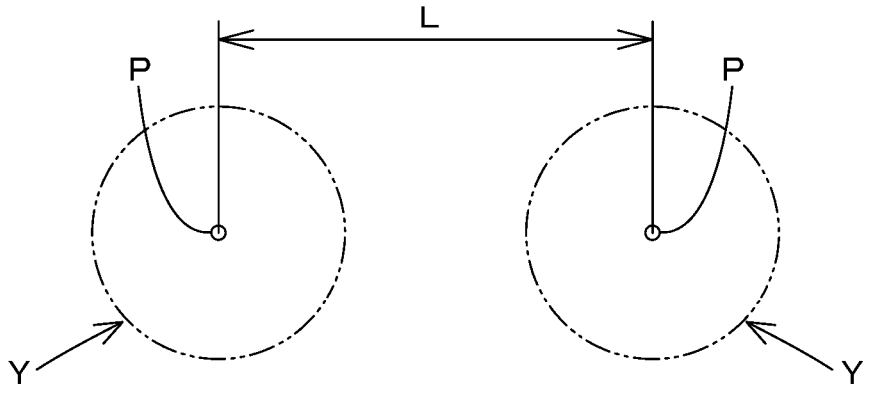

Subsequent to the first injection, grout prepared for the next injection is injected into the interior (center) of the solidified portion X formed by the first injection. Then, as shown in FIGS. 1(B) and 2(B), part of the injected grout, while combining with the solidified portion X formed by the first injection, diffuses around in the form of interlocked tree roots while fracturing the outer side of the solidified portion X under the injection pressure.

Although high injection pressure is required in the next grout injection to cause fracture in the solidified portion X formed by the first injection, once the fracture has occurred, the load is reduced with the consequence that a succeeding grout injection can be performed easily, thus causing rapid diffusive permeation of the grout into the ground G. The thereby diffused grout combines with the nearby soil once again, and merges into the solidified portion X formed by the first injection, whereupon an enlarged solidified portion Y is formed about each grout injection point P.

The enlarged solidified portion Y formed by the next injection tends to diffusively permeate downwardly and horizontally under an impulse resulting from the fracture of the solidified portion X formed by the first injection (injection pressure).

Figure 1C:
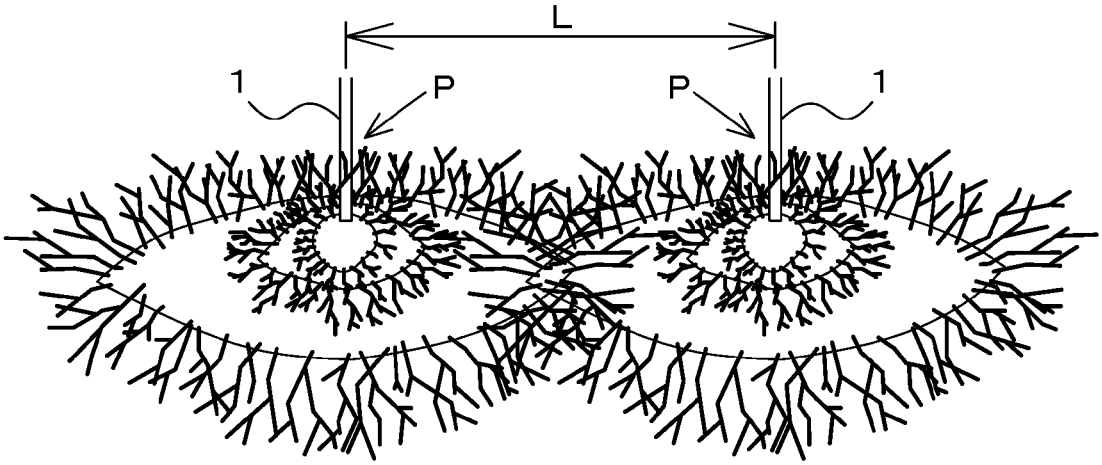
Figure 2C:
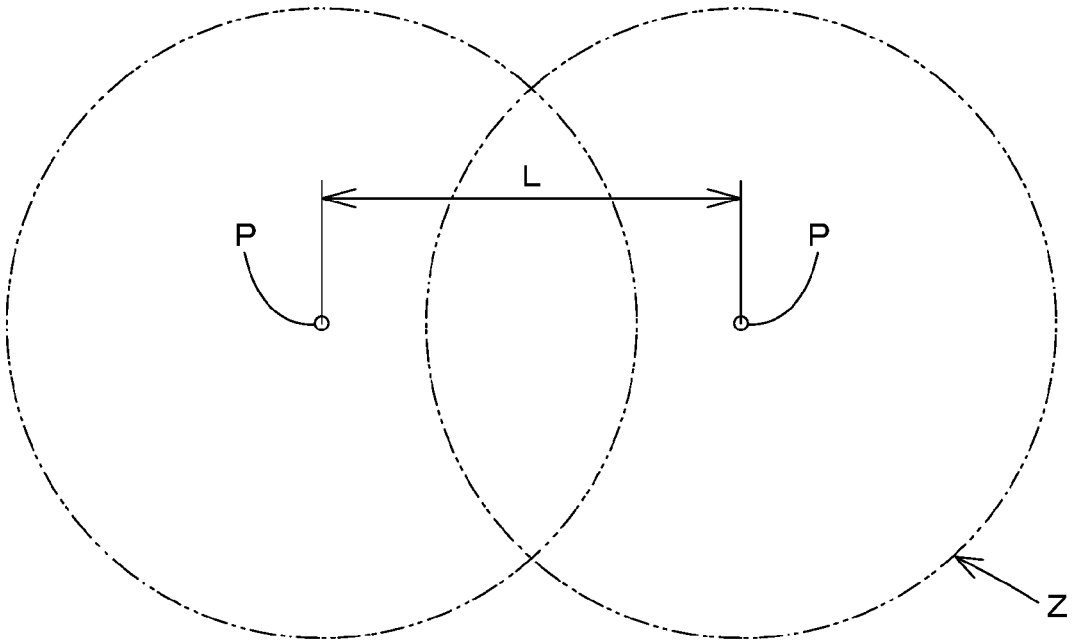

With the repetition of the time-spaced injections, added grouts diffuse around in the form of interlocked tree roots while fracturing the outer side of the enlarged solidified portion Y, thus causing further enlargement of the enlarged solidified portion Y. Consequently, the ground located between the adjacent grout injection points P, P is substantially consolidated under the interaction between the enlarged solidified portions Y, Y formed at their respective grout injection points P, P. The interaction involves the hardening of the ground located between the adjacent grout injection points P, P under the effect of consolidation in a direction in which the grout injection points P, P are opposed to each other, and also involves, as shown in FIGS. 1(C) and 2 (C), a phenomenon in which the permeating grouts diffused from the adjacent enlarged solidified portions Y, Y, respectively, cross each other to combine with the nearby soil.

As a result, a solidified continuum region Z is formed so as to extend along the ground surface within the improvement target ground G, and, this solidified continuum region, in its entirety, constitutes a unitary solidified support layer R of high strength (refer to FIGS. 5 and 6). In the range of diffusion of the solidified support layer R, geological layers lying under and around the solidified support layer R are consolidated.

The state of transition from the solidified portion X to the solidified continuum region Z varies according to relevant conditions, including the degree of consolidation in the yet-to-be-treated improvement target ground G, the type of grout for use, and the amount of grout for single-shot injection. Therefore, the count of the time-spaced injections is not limited to any particular number, and it is essential only that the time-spaced injecting operation be repeated twice or more. For example, work may be conducted in a manner whereby the solidified continuum region Z can be formed at a dash under the interaction between the enlarged solidified portions Y, Y formed at the adjacent grout injection points P, P, respectively, by the second grout injection. Moreover, at that point in time when the solidified continuum region Z was formed, the solidified continuum region Z in itself may be regarded as the solidified support layer R.

In the course of the formation of the solidified support layer R, the distribution of ground surface rises is monitored. For example, the use of a laser level meter helps facilitate the monitoring. When an area having a relatively low surface level is observed during the monitoring, execution of time-spaced injections at the grout injection point P located in this area (area of low surface level) comes first.

On the other hand, when localized prominences, which are swollen spots of the ground surface developed under a reaction force resulting from the formation of the solidified portion X, the enlarged solidified portion Y, or the solidified continuum region Z, are observed at the individual grout injection points P, then the grout injection at the grout injection point P located in this area (swollen area) is brought to a halt, and, the grout injection at the grout injection point P located in another area free of prominences is continued. This renders the upper ends of the swollen areas uniform in level throughout the entire region on the improvement target ground.

The implementation of the above measures makes it possible to sustain the flattening of the ground surface of the entire region on the improvement target ground.

After the setting of the grout injection points P as shown in FIGS. 3 and 4, in actual operation, a hole for injection pipe insertion is formed by excavation at each grout injection point P so as to extend to the grout injection layer. Then, a grout injection pipe is inserted into each injection pipe insertion hole. An excavator equipped with a digging drill (not shown in the drawings) is used for the excavation.

When the improvement target ground G is vast, the target ground area may be divided into a plurality of sections for separate work. In this case, the individual excavation depths for the formation of the injection pipe insertion holes (or the insertion lengths of the inserted grout injection pipes) in the range of a single section are not necessarily the same.

Figure 7:
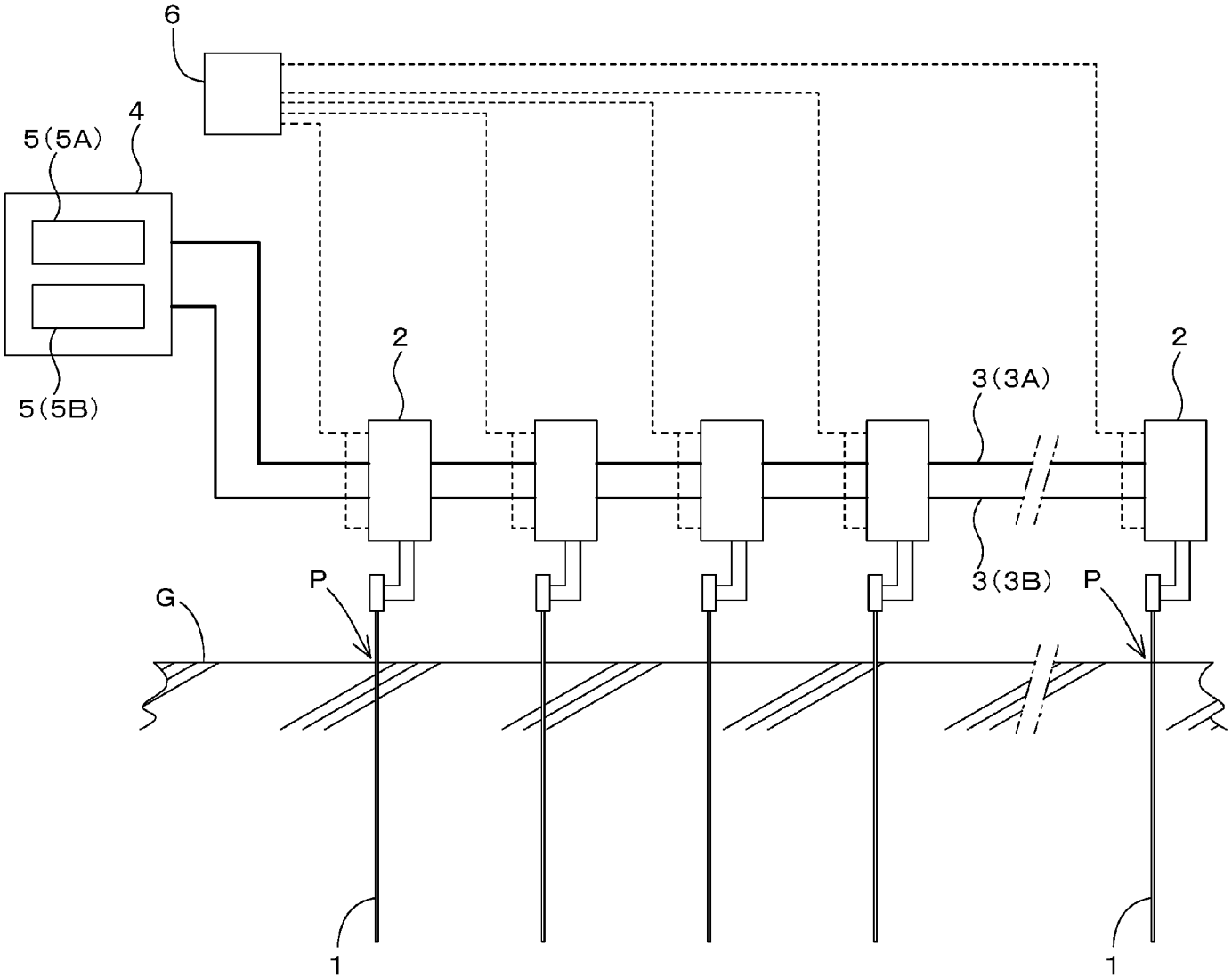
FIG. 7 is a side view schematically showing a grout feeder which may be used in the ground improvement method pursuant to the present invention, and a condition of placement of the grout feeder.

FIG. 7 is a schematic representation showing a condition where a grout injection pipe 1 is inserted in the injection pipe insertion hole at each grout injection point P, distributing means 2 is connected to each grout injection pipe 1, and the distributing means 2 is connected to a grout feeder 4 via a piping member 3 such as a hose.

As a matter of course, a member having a pipe diameter large enough for insertion into the injection pipe insertion hole is used as the grout injection pipe 1. Moreover, the length of the grout injection pipe 1 is adjusted so that its front end (lower end) reaches the grout injection layer within the injection pipe insertion hole, and that the opposite end protrudes beyond the ground surface. Depending on circumstances, it is possible to use a member composed of a few portions that can be separated from and connected to each other via a coupling joint in its lengthwise direction.

As the grout, either of a slowly-hardened grout characterized by long gelation time and an instantaneously-hardened grout characterized by short gelation time may be used. Moreover, the grout may be of a type which is prepared by mixing different agents every time injection is performed. Grout selection is made in accordance with the geological condition of ground.

In the present embodiment, as the grout, use is made of a water-glass injection material (liquid A) and a cement injection material (liquid B) that are used in combination in mixture form. Therefore, the grout injection pipe 1 is constructed of a member having a double-pipe structure capable of feeding the liquid A and the liquid B to the grout injection layer of destination at the same time while preventing mixing of them. Instead of the pipe having a double-pipe structure, a combination of two separate pipes may be used.

Moreover, since the mixing of the liquid A and the liquid B is necessary for grout injection, as the distributing means 2, use is made of a member having a switching valve for the liquid A and a switching valve for the liquid B. For example, a three-way valve, a spool valve, or a needle valve may be adopted for use as each switching valve. It is desirable to adopt a switching valve capable of being remotely controlled, such as a motor-driven valve, an electromagnetically-driven valve, or a fluid pressure (such as air)-driven valve. A plurality of units of the distributing means 2 are required for connection with the individual grout injection pipes 1, and, these units of the distributing means 2 should preferably be incorporated into a placement support frame (not shown in the drawings) in advance in the interest of efficient placement operation.

The grout feeder 4 has a liquid feeding pump capable of feeding grout under pressure. In the present embodiment, because of the use of the liquid A and the liquid B for the grout, two liquid feeding pumps 5, namely a feeding pump for the liquid A (5A) and a feeding pump for the liquid B (5B) are provided, and also, as the piping member 3, a piping member for the liquid A (3A) and a piping member for the liquid B (3B) are provided independently of each other.

The grout feeder 4 (liquid feeding pump 5) and the distributing means 2 (switching valve) are designed to be operable under the control of a control section 6 such as a computer. That is, the control section 6 is configured to be capable of proper setting of conditions of grout injection into each grout injection pipe 1, the sequence of grout injections into a plurality of grout injection pipes 1 (or equivalently the selection of the distributing means 2), and so forth.

The conditions of grout injection include the amount of grout to be injected per single-shot injection (for example, 1 liter) and the time taken to inject this amount of grout for single-shot injection (for example, 3 seconds). Under the control of the control section, upon detection of fulfillment of setting values as to these injection conditions, the supply of grout at the present grout injection point is brought to a halt, and the supply of grout at the next grout injection point selected is started.

Moreover, in setting the sequence of grout injections, a predetermined number of grout injection points P are bunched together in groups, and, in each group, injections are performed sequentially in respective grout injection points P, while repeating supply and stop of the supply in turn at different timings, according to the order of arrangement of the grout injection points P in a go-around manner as one cycle of operation. The injecting operation is performed in a timed relation such that, upon the completion of one cycle, the procedure proceeds to a next cycle.

If the grout injected in the ground G is fully solidified, a succeeding grout injection into this solidified part will be difficult. To cope with such a case, the number of the grout injection points P in a single group is adjusted so that one cycle of operation, namely the injections at all of the grout injection points can be accomplished within the range of grout gelation time (for example, 30 to 60 seconds).

The number of repetition of the cycles may be determined properly based on operator's visual judgment, or, a configuration capable of automatic detection of the formation of the solidified support layer R (for example, a configuration for detecting when grout injection pressure has reached the setting value) may be adopted. In the latter case, the repetition of the cycles is continued until the detection.

As will be apparent from the foregoing detailed description, according to the ground improvement method pursuant to the present invention, the grout solidified support layer R is formed in the ground G by grout injection, and, under a reaction force resulting from the formation, the degree of consolidation in the ground G is increased, and also, in certain circumstances, the level of the surficial area of the ground G can be raised. Thus, not only it is possible to achieve ground improvement for ground G beneath a building construction, but it is also possible to achieve ground improvement for ground G free of a building construction on it and soft ground G.

Moreover, in the ground improvement method pursuant to the present invention, the arrangement of a plurality of grout injection points P at different places on improvement target ground is adapted to geological layer conditions, thus achieving optimum ground improvement for improvement target grounds of varying types on an individual basis.

In addition, in the ground improvement method pursuant to the present invention, improvement construction work can be executed with use of relatively simple equipment without the necessity of preparing large-sized equipment instruments and special pumps, thus achieving the shortening of construction period and construction cost reduction.

Figure 8:
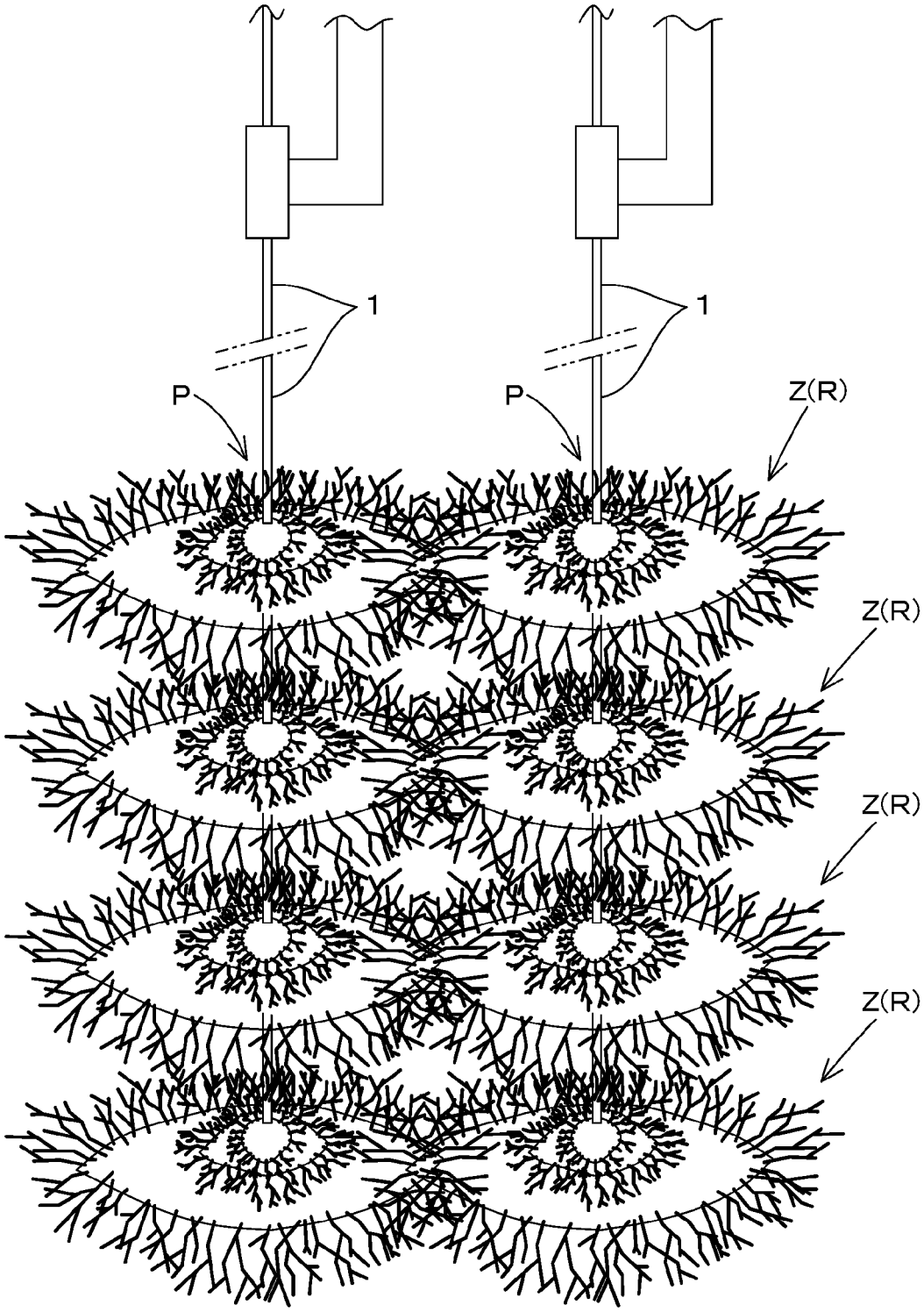
FIG. 8 is a lateral sectional view schematically illustrating solidified support layers formed in accordance with the second embodiment of the ground improvement method pursuant to the present invention.

FIG. 8 is a view showing the second embodiment of the ground improvement method pursuant to the present invention. The most distinctive difference of the second embodiment from the first embodiment resides in the setting of a plurality of grout injection layers for the individual grout injection points P, respectively, in a depth direction. The first step is to form a solidified support layer R in correspondence with the deepest one of the thereby set grout injection layers. After the formation of the solidified support layer R at one depth position, the depth at which grout injection is performed is shifted to the position of another grout injection layer one step higher than the previous depth position. In so doing, the solidified support layers R in multi-stage form can be formed.

The procedural steps to form the solidified support layer R are the same as those adopted in the first embodiment. That is, the solidified portion X is formed in the first injection, and then the enlarged solidified portion Y is formed, thus forming the solidified continuum region Z (there may be a case where the formation of the enlarged solidified portion Y is omitted).

Otherwise, the second embodiment is substantially the same as the first embodiment in other work procedure, equipment in use, advantageous effects produced by each operation, and so forth.

To shift the depth at which grout injection is performed to the position of another grout injection layer one step higher than the previous depth position, a drive is imparted to that part of the grout injection pipe 1 which protrudes beyond the ground surface to lift the grout injection pipe 1 up. The lifting of the grout injection pipe 1 is effected by operating, for example, a manual or hydraulic jack unit (not shown in the drawings) placed on the ground.

In the case of forming an additional solidified support layer R above the previously formed solidified support layer R (lower layer), the new solidified support layer R induces a reaction force when formed by exploiting the previously formed solidified support layer R as a platform. Thus, the new solidified support layer R and an area above it including a nearby area are conducive to a rise of ground surface level.

Therefore, from observation with each grout injection point P, it will be seen that ground surface-level raising effects are successively accumulated from the deep area of the ground G to the ground surface with consequent enhancement in the degree of consolidation in the ground as a whole. Furthermore, by virtue of the formation of the solidified support layers R in multi-stage form at each of a plurality of the grout injection points P in a similar manner, high consolidating strength can be obtained over a horizontally extending wide area between the individual grout injection points P, thus imparting very high soil stability to the ground.

It should be noted that the present invention is not limited to the embodiments as described heretofore, but may be modified in accordance with the forms of the embodiments.

For example, although the grout injection points P are illustrated as being arranged in two (or more) rows in FIGS. 3 and 4, they may be arranged in a row.

In forming the injection pipe insertion hole for the insertion of the grout injection pipe 1 at each grout injection point P, either of excavation using machines and excavation using manpower may be adopted, or, as an alternative method, the grout injection pipe 1 may be penetrated directly into the ground by a pneumatic hammer.

In another alternative, there is a method which does not involve the formation of the injection pipe insertion hole by excavation. More specifically, for example, a digging cutter is attached to the lower end of the grout injection pipe 1, and this grout injection pipe 1 is rotatably driven to move downward so as to be inserted piercingly into the ground G.

This method allows savings in time and in manpower in the formation of the injection pipe insertion hole by excavation, thus achieving the shortening of construction period. Another advantage is that whether the lower end of the grout injection pipe 1 has reached the grout injection layer of destination can be checked with ease. Still another advantage is that the monitoring of rotational load during excavation may lead to detection of geological variation in the nature of the soil (for example, the presence of stiff soil layers such as sand gravel layers) in the direction of layer thickness, In this case, appropriate measures can be taken. In addition, the grout injection pipe 1 can be inserted so as to extend deep into the ground.

When the adjacent distance L between the grout injection points P is narrowed on purpose, the consolidating strength of the ground G may be further increased, or even higher ground surface-level raising force may be obtained. Such a phenomenon can be utilized to determine the arrangement of the grout injection points P.

In effecting grout injection at each grout injection point P, for example, when there are grout injection layers lying at different levels, namely at a higher position and a lower position, respectively, in a single section within the ground, it is possible to achieve the balance in the section by exercising control so that the number of grout injections and the amount of grout injection for the grout injection layer in the higher position are reduced relative to those for the grout injection layer in the lower position.

EXPLANATION OF REFERENCE SYMBOLS

1 grout injection pipe
2 distributing means
3 piping member
4 grout feeder
5 liquid feeding pump
6 control section
m highly consolidated layer
n lowly consolidated layer
R solidified support layer
X solidified portion
Y enlarged solidified portion
Z solidified continuum region

The invention claimed is:

1. A ground improvement method comprising:

determining a degree of consolidation at a depth position at which grout injection is to be performed within ground which is a target of ground improvement;

predicting a permeation radius at which grout will permeate first about each grout injection point on the basis of the degree of consolidation obtained at the depth position and an amount of grout to be injected per single-shot injection;

setting a plurality of grout injection points so as to be spaced apart by an adjacent distance which is greater than twice said permeation radius so predicted;

starting time-spaced injections at each grout injection point in accordance with a cycle of operation comprising single-shot grout injection, pausing for a certain period of time required for solidification of injected grout, and at least one additional single-shot grout injection at each grout injection point; and causing grout injected in a first injection to form an independent solidified portion at each grout injection point, and causing grout injected in a next injection to diffuse around in a form of interlocked tree roots, while fracturing the solidified portion formed by the first injection, for formation of an enlarged solidified portion.

2. The ground improvement method according to claim 1, further comprising:

forming a solidified support layer extending along ground surface within said improvement target ground by repeating said time-spaced injections until the ground located between adjacent grout injection points is consolidated under an interaction between the enlarged solidified portions formed at their respective grout injection points.

3. The ground improvement method according to claim 2, wherein the interaction between said enlarged solidified portions involves a condition where the enlarged solidified portions cross each other.

4. The ground improvement method according to claim 2, wherein a distribution of ground surface rises is monitored in a course of formation of said solidified support layer, and, when a grout injection point situated in a locally swollen area is observed, then grout injection at the grout injection point is brought to a halt, yet grout injection at a grout injection point situated in a prominence-free area is continued, so that upper ends of swollen areas can be rendered uniform in level throughout an entire region on the improvement target ground.

5. The ground improvement method according to claim 2, wherein a distribution of ground surface rises is monitored in a course of formation of said solidified support layer, and, when an area having a relatively low surface level is observed, execution of said time-spaced grout injections at a grout injection point situated in this area comes first, so that flattening of the ground surface of the entire region on the improvement target ground can be sustained.

6. The ground improvement method according to claim 2, wherein a plurality of depth positions at which grout injection is to be effected are set for individual grout injection points, respectively, and, after formation of a solidified support layer at a deepest one of the thereby set depth positions, a grout injection depth is shifted to a position one step higher than the previous depth position, so that solidified support layers vertically arranged in multi-stage form can be formed at each grout injection point.

7. The ground improvement method according to claim 2, wherein a time interval between termination of single-shot grout injection at a certain grout injection point and initiation of a succeeding grout injection at the same grout injection point is shorter than gelation time of the previously injected grout.

8. The ground improvement method according to claim 2, wherein, when a result of geological survey conducted on said improvement target ground in a direction of geological layer thickness has indicated a presence of a stack of a highly consolidated layer having a high degree of consolidation and a lowly consolidated layer having a low degree of consolidation located below the highly consolidated layer within a range corresponding to a depth at which ground improvement is to be effected, then said lowly consolidated layer is defined as a depth position at which grout is injected.

9. The ground improvement method according to claim 2, wherein, in effecting grout injection at said grout injection points, a certain number of grout injection points are bunched together in groups, and, according to an order of arrangement of a plurality of grout injection points in each group, injections are performed sequentially in respective grout injection points, while repeating supply and stop of the supply in turn at different timings, in a go-around manner as one cycle of operation, and, upon a completion of one cycle, a procedure proceeds to a next cycle.

10. The ground improvement method according to claim 1, wherein a time interval between termination of single-shot grout injection at a certain grout injection point and initiation of a succeeding grout injection at the same grout injection point is shorter than gelation time of the previously injected grout.

11. The ground improvement method according to claim 1, wherein, when a result of geological survey conducted on said improvement target ground in a direction of geological layer thickness has indicated a presence of a stack of a highly consolidated layer having a high degree of consolidation and a lowly consolidated layer having a low degree of consolidation located below the highly consolidated layer within a range corresponding to a depth at which ground improvement is to be effected, then said lowly consolidated layer is defined as a depth position at which grout is injected.

12. The ground improvement method according to claim 1, wherein, in effecting grout injection at said grout injection points, a certain number of grout injection points are bunched together in groups, and, according to an order of arrangement of a plurality of grout injection points in each group, injections are performed sequentially in respective grout injection points, while repeating supply and stop of the supply in turn at different timings, in a go-around manner as one cycle of operation, and, upon a completion of one cycle, a procedure proceeds to a next cycle.

* * * * *